US008752590B2

(12) United States Patent
Petty et al.

(10) Patent No.: US 8,752,590 B2
(45) Date of Patent: Jun. 17, 2014

(54) EXTENDABLE ROPE PROTECTING SLEEVE

(71) Applicants: David Donald Petty, Cedar City, UT (US); Richard DeMille Petty, Cedar City, UT (US)

(72) Inventors: David Donald Petty, Cedar City, UT (US); Richard DeMille Petty, Cedar City, UT (US)

( * ) Notice: Subject to any disclaimer, the term of this patent is extended or adjusted under 35 U.S.C. 154(b) by 0 days.

(21) Appl. No.: 13/894,847

(22) Filed: May 15, 2013

(65) Prior Publication Data

US 2013/0319566 A1 Dec. 5, 2013

Related U.S. Application Data

(60) Provisional application No. 61/653,169, filed on May 30, 2012.

(51) Int. Cl.
*F16L 57/00* (2006.01)

(52) U.S. Cl.
USPC ..... 138/110; 138/108; 138/107; 254/389

(58) Field of Classification Search
USPC ..... 138/110, 118, 106–108, 109, 178; 254/389
See application file for complete search history.

(56) References Cited

U.S. PATENT DOCUMENTS

| | | | | |
|---|---|---|---|---|
| 3,431,947 | A * | 3/1969 | Hines | 138/106 |
| 4,231,208 | A * | 11/1980 | Willox | 52/741.3 |
| 4,402,489 | A * | 9/1983 | Murray | 254/389 |
| 4,929,478 | A * | 5/1990 | Conaghan et al. | 428/35.1 |
| 5,226,456 | A * | 7/1993 | Semak | 138/107 |
| 5,535,787 | A * | 7/1996 | Howell | 138/167 |
| 5,901,756 | A * | 5/1999 | Goodrich | 138/167 |
| 6,341,626 | B1 | 1/2002 | Davenport | |
| 7,325,575 | B1 * | 2/2008 | O'Donnell et al. | 138/110 |
| 7,703,372 | B1 | 4/2010 | Shakespeare | |
| 7,814,938 | B2 * | 10/2010 | Davis et al. | 138/106 |
| 2006/0249212 | A1 * | 11/2006 | Kressierer/Huber et al. | 138/33 |

* cited by examiner

*Primary Examiner* — Patrick F Brinson

(57) ABSTRACT

An extendable rope protecting sleeve is provided as an apparatus that extends over an existing climbing rope providing a barrier that protects said climbing rope from fraying and weakening as a result of direct contact with damaging surfaces. The expandable rope protecting sleeve shrouds a climbing rope during a climber's descent with minimal interference to the climber's range of motion. The apparatus provides the extendable sleeve with a detachable engagement through a breakaway wrist strap in order reduce the likelihood of the climber being encumbered by the apparatus. Additionally, the detachable engagement is provided in a manner that avoids a sudden jerking sensation upon detachment. Through the combination of the aforementioned components the apparatus is able to slowly expand over a climbing rope covering exposed sections of the climbing rope during the climber's descent.

14 Claims, 7 Drawing Sheets

EXTENDABLE ROPE PROTECTING SLEEVE

The current application claims a priority to the U.S. Provisional Patent application Ser. No. 61/653,169 filed on May 30, 2012.

FIELD OF THE INVENTION

The present invention relates generally to a rock climbing accessory, more specifically, to a rope protecting sleeve that extends over the length of a climbing rope during use in order to prevent abrasive surfaces such as rocks, branches, and debris from fraying or weakening the climbing rope.

BACKGROUND OF THE INVENTION

Rock climbing is an activity that is both mentally and physically demanding. Climbers compete with themselves and their environment to reach the summits of a formation or other predefined goals. The sport tests a climber's endurance, agility, and strength while providing an element of danger, which although minimal if executed properly, requires the climber to exercise mental control to ensure completion of their goal. Once a climber reaches the summit or their set goal they can begin a controlled descent down the same rock face.

A controlled descent, commonly referred to as abseiling or rappelling, is a technique to descend down a mountain face, cliff, or slope that may pose a danger to the climber or individual if they attempt to descend the area without protective equipment. Abseiling or rappelling is commonly used in a variety of situations that include but are not limited to, climbing, canyoneering, caving, and rescue operations. The basic equipment for rappelling includes a climbing or rappelling rope, an anchor, a rappelling device, and a climbing harness. The climber is able to control their rappel by having their rope attached to an anchoring point and using a rappelling device to apply friction to the rope as they move down a surface. Unfortunately, the rappelling device is not the only thing that can cause friction to a climber's rope. The surface a climber is descending can have a plurality of rough or sharp points of contact that can potentially damage the climber's rope. These rough or sharp points of contact can reduce the ropes strength and potentially create a life threatening situation for the climber.

While there are several prior art that attempt to reduce abrasion from contacting surfaces on a climbing rope, most of the prior art are ineffective in use or are disadvantageous for descending a rock face. one prior art example is U.S. Pat. No. 7,325,575, A Rope and Webbing Protector, which describes a tubular protector that rolls around a section of a rope. While this prior art prevents direct contact to the section of rope covered by the apparatus, it is unable to protect the climbing rope multiple contact points during a descent. Another prior art example is U.S. Pat. No. 6,341,626, Flexible Protective Sleeve, which describes a protective sleeve that slides over a rope or similar tubular device and attaches itself through the use of an adhesive. While this prior art protects the portion of the rope from abrasive surfaces, the permanent/semi permanent attachment method limits the functionality of the particular rope during use.

It is therefore the object of the present invention to provide an apparatus that extends over an existing climbing rope providing a barrier that protects the climbing rope from fraying and weakening as a result of direct contact with damaging surfaces. The apparatus utilizes an extendable sleeve that is detachably engaged to a breakaway wrist strap in order to protect the climbing rope from damaging surfaces. The extendable sleeve functions as a barrier that prevents direct contact between the climbing rope and damaging surfaces. The breakaway wrist strap functions as the attachment means between the climber and the extendable sleeve that easily detaches from the extendable sleeve without a sudden jerk. The apparatus extends over the length of the climbing rope from a compressed state as the climber makes a descent.

BRIEF DESCRIPTIONS OF THE DRAWINGS

DETAIL DESCRIPTIONS OF THE INVENTION

All illustrations of the drawings are for the purpose of describing selected versions of the present invention and are not intended to limit the scope of the present invention.

Figure 1:
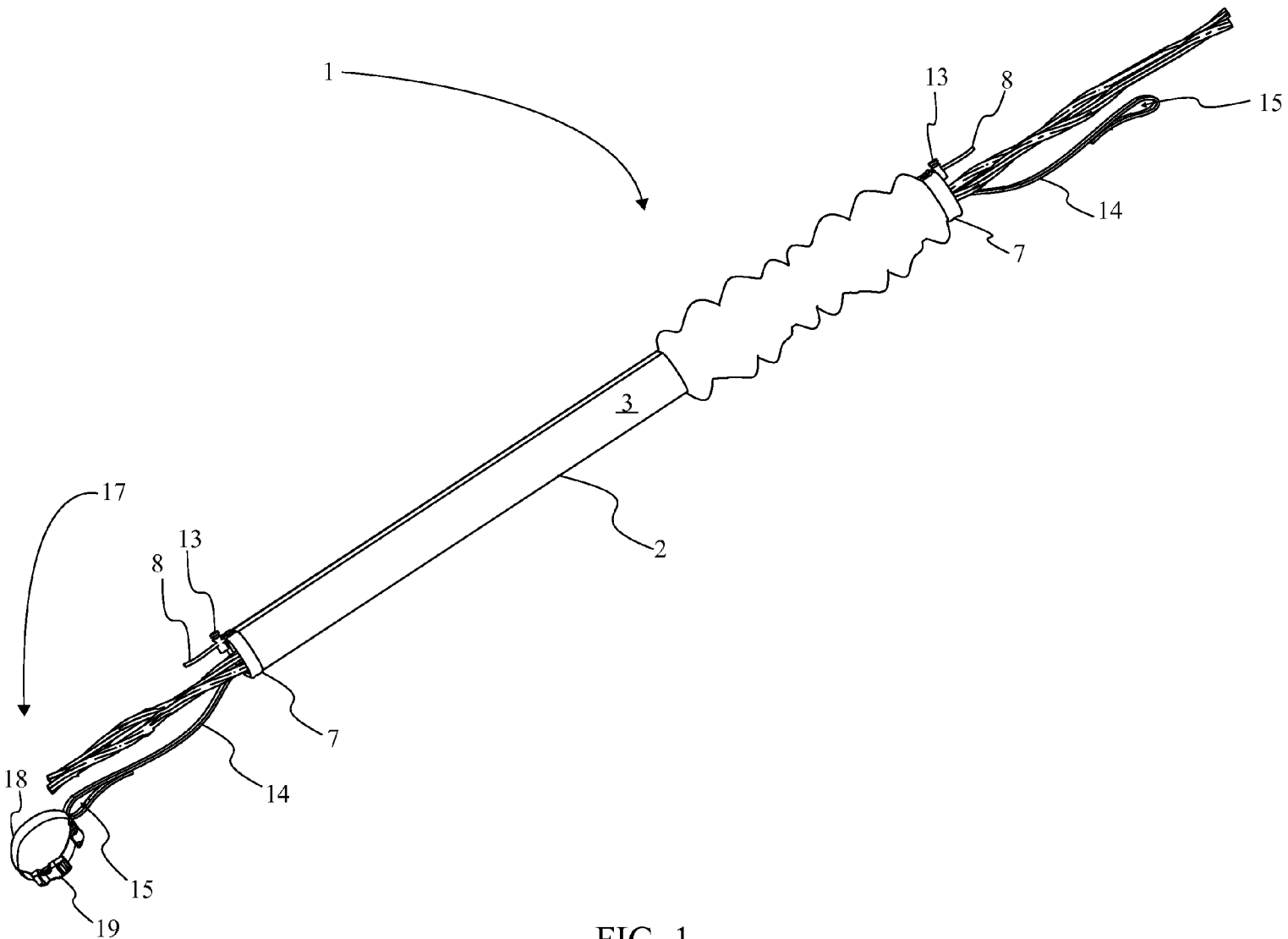
FIG. 1 is a perspective view displaying the extendable sleeve and the breakaway wrist strap detachable coupled as per the current embodiment of the present invention.

Referencing FIG. 1, the present invention is an extendable rope protecting sleeve that extends over an existing climbing rope providing a barrier that protects the climbing rope from fraying and weakening as a result of direct contact with damaging surfaces. The extendable climbing rope comprises an extendable sleeve 1 and a breakaway wrist strap 17. The extendable sleeve 1 is a barrier that surrounds a climbing rope, protecting it from direct contact with a damaging surface. The extendable sleeve 1 protects the climbing rope during a descent by extending over portions of exposed rope as a climber makes a descent. The breakaway wrist strap 17 functions as an attachment point between a climber and the extendable sleeve 1. The breakaway wrist strap 17 provides the climber with a means of extending the extendable sleeve 1 over portions of exposed rope during their descent. The breakaway wrist strap 17 is provided with a detachable engagement with the extendable sleeve 1. The detachable engagement between the extendable sleeve 1 and the breakaway wrist strap 17 is provided as a safety feature that enables facilitated detachment from the apparatus that reduces the risk of entanglement. The detachable engagement between the extendable sleeve 1 and the breakaway wrist strap 17 are provided with a low jerk detachable engagement which prevents sudden changes in resistance between the climber and the apparatus.

Figure 2:
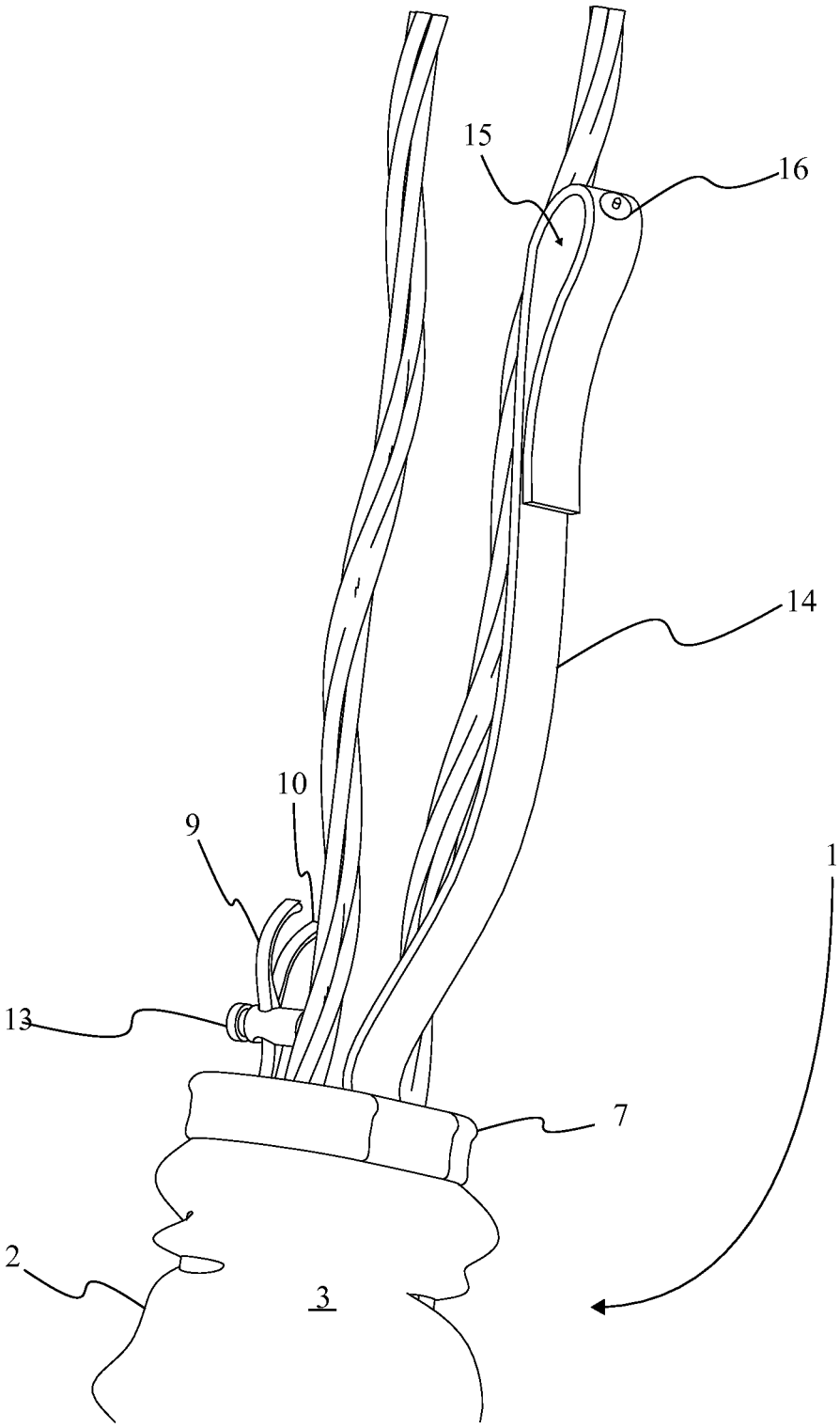
FIG. 2 is an enhanced view displaying the component distribution of the width adjuster mechanism and the breakaway recovery strap as per the current embodiment of the present invention.
Figure 3:
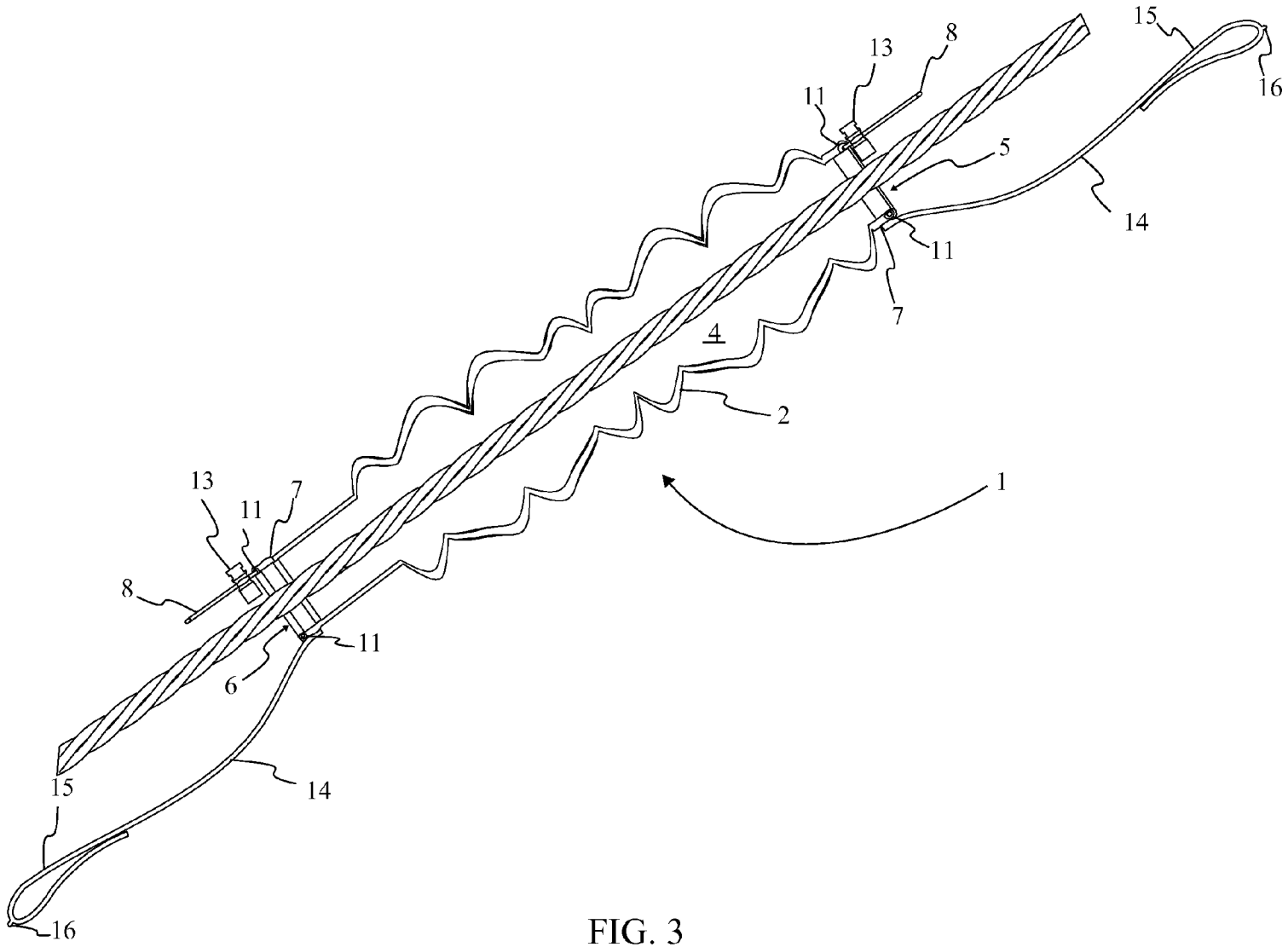
FIG. 3 is a cross sectional view displaying the component distribution of the extendable sleeve in a compressed configuration as per the current embodiment of the present invention.

Referencing FIGS. 1-3, the extendable sleeve 1, in the current embodiment of the present invention, is a flexible barrier that can extends over a climbing rope during a descent. The extendable sleeve 1 prevents direct contact between the climbing rope and damaging surfaces by extending over portions of exposed rope as the climber makes their descent. In the current embodiment of the present invention, the extendable sleeve 1 comprises a lateral protective surface 2, a first sleeve opening 5, and a second sleeve opening 6. The lateral protective surface 2 is the portion extendable sleeve 1 that functions as a barrier between the climbing rope and the damaging surfaces. The first sleeve opening 5 and the second sleeve opening 6 provide the climbing rope with the means of engaging the extendable sleeve 1. The first sleeve opening 5 and the second sleeve opening 6 are terminally positioned on the extendable sleeve 1, wherein the first sleeve opening 5 is positioned opposite to the second sleeve opening 6. Lateral protective surface 2 is found positioned between the first sleeve opening 5 and the second sleeve opening 6. The first sleeve opening 5, the lateral protective surface 2 and the second sleeve are arranged in manner that enables central alignment between the three components. The central alignment is a collinear arrangement that provides a traversal path for the climbing rope through the extendable sleeve 1.

Referencing FIG. 2 and FIG. 3, the lateral protective surface 2, in the current embodiment of the present invention, is the most visible portion of the extendable sleeve 1. The lateral protective surface 2 shrouds a climbing rope positioned with the extendable sleeve 1. The lateral protective surface 2 is provided with a flexible construction permitting the lateral protective surface 2 to be compressible between the first sleeve opening 5 and the second sleeve opening 6. In the current embodiment of the present invention the lateral protective surface 2 comprises an exterior lateral surface 3 and an interior lateral surface 4. The exterior lateral surface 3 is the portion of the lateral protective surface 2 that directly contacts the damaging surfaces. The interior lateral surface 4 is the portion of the lateral protective surface 2 that directly contacts the climbing rope. The interior lateral surface 4 and the exterior lateral surface 3 are provided as a bi-layer construction of the lateral protective surface 2. Resultantly, the interior lateral surface 4 is found positioned concentric to the exterior lateral surface 3. The exterior lateral surface 3 is found peripherally positioned to the extendable sleeve 1 opposite the interior lateral surface 4, wherein the exterior lateral surface 3 is the exposed portion of the lateral protective surface 2.

Referencing FIG. 3, the first sleeve opening 5 and the second sleeve opening 6, in the current embodiment of the present invention, function as access points for the climbing rope. In the current embodiment of the present invention, both the first sleeve opening 5 and the second sleeve opening 6 each comprise a width adjuster mechanism 7 and a breakaway recovery strap 14. The breakaway recovery strap 14 is provided as an attachment point for the breakaway wrist strap 17 as well as a connector for a recovery line to retrieve the extendable sleeve 1 after a descent. The breakaway recovery strap 14 allows the climber to pull the extendable sleeve 1, shrouding exposed sections of the climbing rope during a descent. The width adjuster mechanism 7 is provided as a means of retaining the extendable sleeve 1 around the climbing rope at either the first sleeve opening 5 or the second sleeve opening 6. The width adjuster mechanism 7 of the first sleeve opening 5 is found circumferentially positioned to the first sleeve opening 5 while the width adjuster mechanism 7 of the second sleeve opening 6 is found circumferentially positioned to the second sleeve opening 6. The breakaway recovery strap 14 of the first sleeve opening 5 is found tangentially positioned to the width adjuster mechanism 7 of the first sleeve opening 5. The breakaway recovery strap 14 of the second sleeve opening 6 is found circumferentially positioned to the width adjuster mechanism 7 of the second sleeve opening 6. The breakaway recovery strap 14 of the first sleeve opening 5 is extendably coupled to the lateral protective surface 2 by way of the width adjuster mechanism 7 of the first sleeve opening 5. The breakaway recovery strap 14 of the second sleeve opening 6 is extendably coupled to the lateral protective surface 2 by way of the width adjuster mechanism 7 of the second sleeve opening 6.

Referencing FIG. 2 and FIG. 3, the width adjuster mechanism 7, in the current embodiment of the present invention, is provided as the means of retaining either terminal end of the extendable sleeve 1 coincident with the first sleeve opening 5 or the second sleeve opening 6 to a climbing rope. The width adjuster mechanism 7 is found coincident with the lateral protective surface 2, wherein the width adjuster mechanism 7 of the first sleeve opening 5 and the width adjuster mechanism 7 of the second sleeve opening 6 are found coincident with the lateral protective surface 2 proximal to the first sleeve opening 5 and the second sleeve opening 6, respectively. In the current embodiment of the present invention, the width adjuster mechanism 7 comprises a drawstring 8, a drawstring channel 11, and a drawstring lock 13. The drawstring 8 is provided as a tensioning cord that reduces the size of the width adjuster mechanism 7. The drawstring channel 11 is the interior portion of the width adjuster mechanism 7 that compresses as a result of tension form the drawstring 8. The drawstring lock 13 is the means of the retaining the tension applied to the drawstring 8. In the current embodiment of the present invention, the drawstring 8 comprises a first drawstring end 9 and a second drawstring end 10 while the drawstring channel 11 comprises channel openings 12. The first drawstring end 9 and the second drawstring end 10 are the terminal ends of the drawstring 8 that vary in length depending The drawstring channel 11 is found positioned between the exterior lateral surface 3 and the interior lateral surface 4, wherein the positioning of the drawstring channel 11 between the exterior lateral surface 3 and the interior lateral surface 4 enables tension from the drawstring 8 to constricting the lateral protective surface 2 around the climbing. The drawstring 8 traverses the drawstring channel 11 by way of the channel openings 12, wherein the drawstring 8 and the drawstring channel 11 partially share a cordial alignment with the portion of the drawstring 8 found positioned within the drawstring channel 11. The first drawstring end and the second drawstring end 10 are found peripherally positioned to the drawstring channel 11, wherein the first drawstring end 9 and the second drawstring end 10 are considered the portions of the drawstring 8 that are extend outwards to the channel openings 12. The drawstring lock 13 is traversed by both the first drawstring end 9 and the second drawstring end 10. The drawstring lock 13 is found proximally positioned to the drawstring 8 openings, wherein the drawstring lock 13 retains its position on the first drawstring end 9 and the second drawstring end 10 enabling securing the constriction of width adjuster mechanism 7.

Referencing FIG. 2, the breakaway recovery strap 14, in the current embodiment of the present invention, functions as the engagement point between the extendable sleeve 1 and the breakaway wrist strap 17. The breakaway recovery strap 14 additionally serves as an attachment point for a recovery line, which is utilized to retrieve the extendable sleeve 1 after a descent. The breakaway recovery strap 14 is found coupled peripherally to the width adjuster mechanism 7 with a positioning that places opposite to the location of the drawstring lock 13. In the current embodiment of the present invention the breakaway recovery strap 14 comprises a loop strap 15 and a first snap buckle 16. The loop strap 15 is a formed portion of the breakaway recovery strap 14 that enables the attachment of the recovery line and non-specific couplers such as carabineers. The first snap buckle 16 is provided as an attachment point with the breakaway wrist strap 17. The loop strap 15 is found distally positioned to the width adjuster mechanism 7, wherein the loop of the loop strap 15 is terminally positioned on the end of the breakaway recovery strap 14 that is furthest away from the width adjuster mechanism 7. The first snap buckle 16 is found peripherally positioned on the breakaway recovery strap 14 adjacent to the loop strap 15, wherein the first snap buckle 16 is positioned nearest to the loop of the loop strap 15. The first snap buckle 16 is a complimentary component, and as such couples to a second snap buckle 20. The first snap buckle 16 is found detachably engaged to the second snap buckle 20 of the breakaway wrist strap 17.

Figure 4:
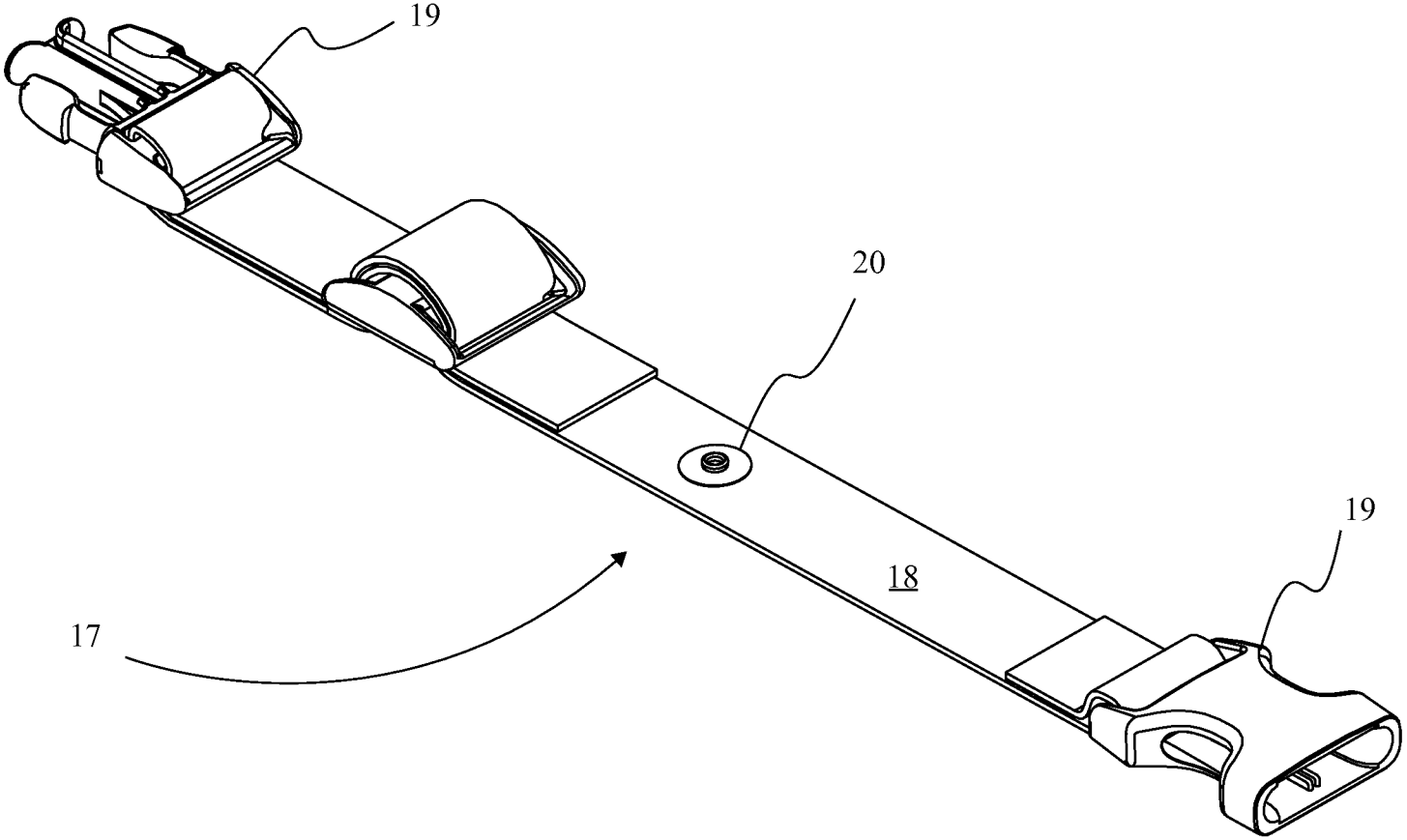
FIG. 4 is a perspective view displaying the breakaway wrist strap and the component distribution of the adjustable band, the strap fastener, and the second snap buckle in an open configuration as per the current embodiment of the present invention.
Figure 5:
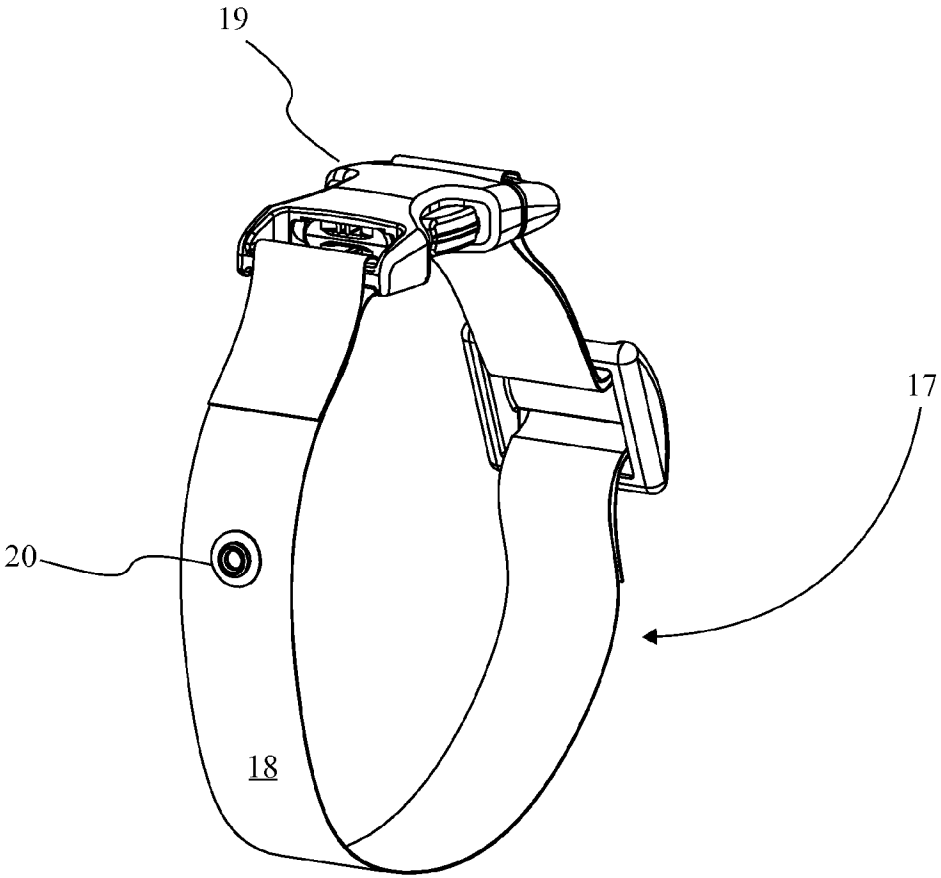
FIG. 5 is a perspective view displaying the breakaway wrist strap and the component distribution of the adjustable band, the strap fastener, and the second snap buckle in a closed configuration as per the current embodiment of the present invention.

Referencing FIG. 4 and FIG. 5, the breakaway wrist strap 17, in the current embodiment of the present invention, is provided as a means to shroud the extendable sleeve 1 over exposed portions of the climbing rope during a descent. In the current embodiment of the present invention, the breakaway wrist strap 17 comprises an adjustable band 18, a strap fastener 19, and a second snap buckle 20. The adjustable band 18 is the strap portion of the breakaway wrist strap 17 that is secured around a climber's wrist. The strap fastener 19 is the coupler that secures and adjusts the adjustable band 18 to the climber's wrist. The second snap buckle 20 is provided as a detachable engagement method that couples to the first snap buckle 16 of the breakaway recovery strap 14. The adjustable band 18 is found securable by the strap fastener 19, wherein the securable engagement is provided as a detachable engagement method that adjusts and retains the adjustable band 18 to the climber's wrist. The second snap buckle 20 is found peripherally positioned on the adjustable band 18, wherein the peripheral positioning of the adjustable band 18 enables facilitated attached to the breakaway recovery strap 14. The second snap buckle 20 is found detachably engaged to the breakaway recovery strap 14 by way of the first snap buckle 16, wherein the first snap buckle 16 and the second snap buckle 20 are provided as complementary components. The detachable engagement between the first snap buckle 16 and the second snap buckle 20 is provided as a low jerk detachable engagement which prevents sudden changes in resistance between breakaway wrist strap 17 and the breakaway recovery strap 14.

Figure 6:
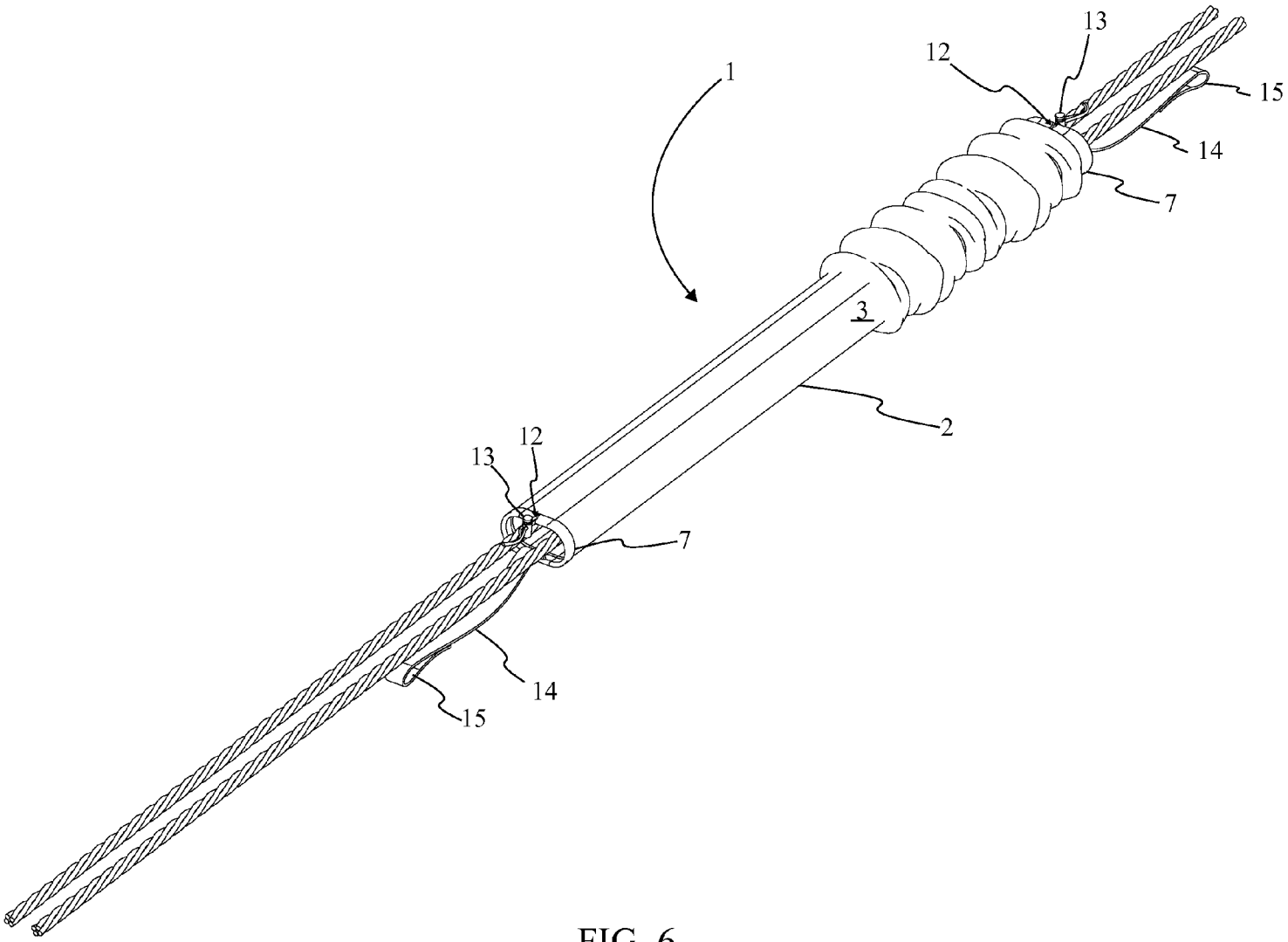
FIG. 6 is a perspective view displaying the extendable sleeve compressed and partially covering the portions of the climbing rope per the current embodiment of the present invention.
Figure 7:
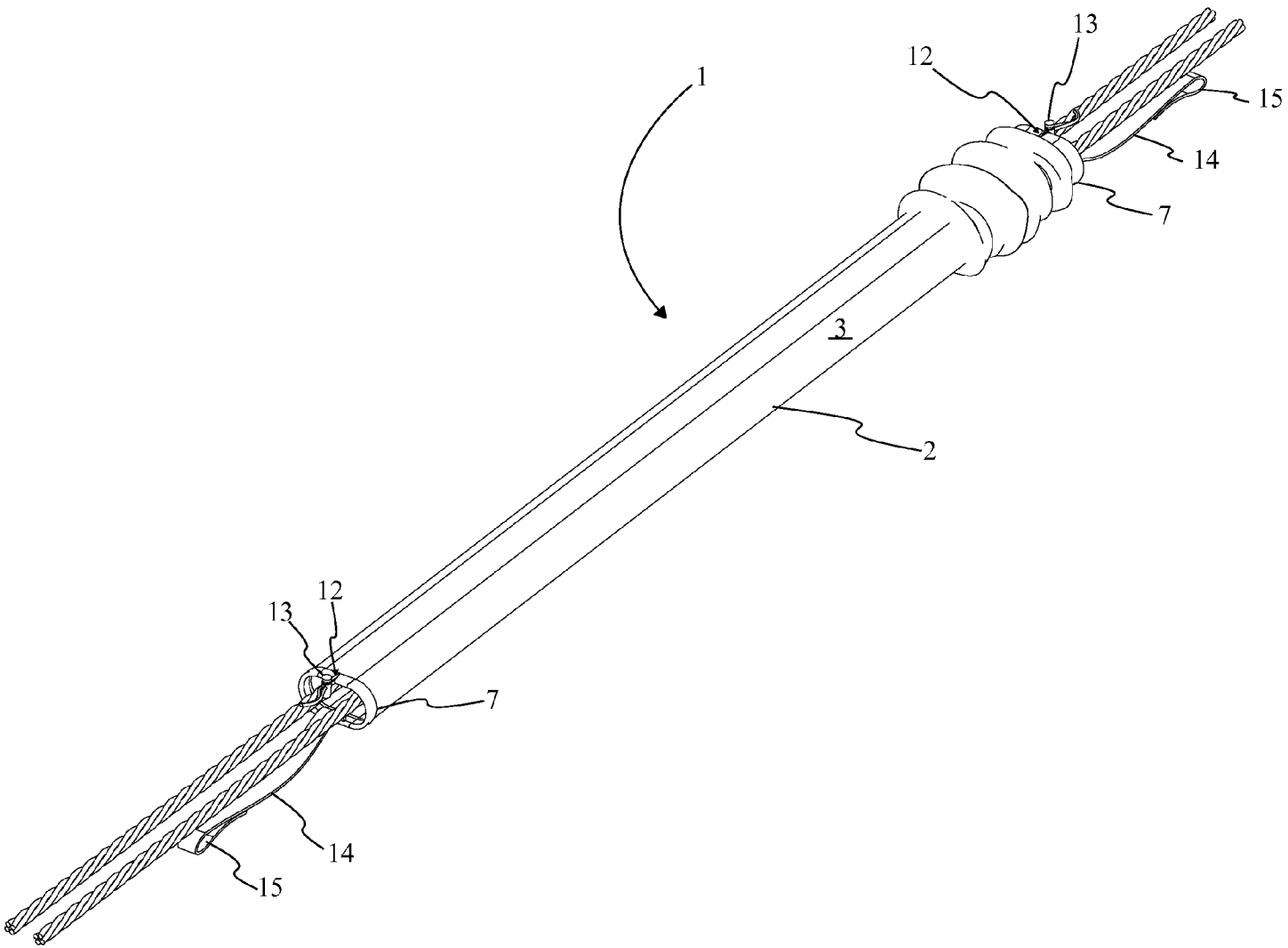
FIG. 7 is a progression of FIG. 6 displaying the extendable sleeve covering a larger portion of the climbing rope as it extends as per the current embodiment of the present invention.

Referencing FIG. 6 and FIG. 7, in the current embodiment of the present invention, the expandable rope protecting sleeve functions as an expandable and collapsible shroud that is disposed over a climbing rope protecting it from directly contacting rough surfaces. The expandable rope protecting sleeve provides a climber with access to the climbing rope with minimal interference reducing the likelihood of the user being encumbered by the apparatus. Initially the climber would thread a climbing rope they wish to protect through the expandable rope protecting sleeve. The expandable rope protecting sleeve would utilize the drawstring 8 of the width adjuster mechanism 7 to create a snug fit about the diameter of the climbing rope by constricting the first sleeve opening 5 and the second sleeve opening 6. When the expandable rope protecting sleeve is retained against the climbing rope, the climber would compress the lateral protective surface 2 by moving the terminal end of extendable sleeve 1 associated with the first sleeve opening 5 towards the terminal end of the extendable sleeve 1 associated with the second sleeve opening 6. The climber would then move the expandable rope protecting sleeve towards the climbing ropes anchor point. The terminal end of the rope protecting sleeve positioned proximal to the climbing ropes anchor point would be provided with a passive or secure engagement means wherein the passive engagement is achieved by the width adjuster mechanism 7 while the secure engagement is accomplished by coupling of the breakaway recovery strap 14 to the anchor point by way of a non-specific coupler such as a carabineer. The expandable rope protecting sleeve is held in a collapsed state by the terminal end of the expandable sleeve distal from the anchor points by way of the width adjuster mechanism 7. With preparations complete and the expandable rope protecting sleeve properly mounted on the climbing rope, the climber would securely attach the breakaway wrist strap 17 to their wrist by way of the strap fastener 19. The climber would then secure the breakaway wrist strap 17 to the breakaway recovery strap 14 through the detachable engagement provided by the second snap buckle 20 and the first snap buckle 16, respectively. Upon initiating a descent, the climber would pull the expandable rope protecting sleeve over exposed portions of the climbing rope by way of the extendable coupling between the breakaway recovery strap 14 and the lateral protective surface 2. The aforementioned engagement would enable the climber to slowly expand the expandable rope protecting sleeve covering exposed sections of the climbing rope that the climber passes on their descent. Once the climber reaches the bottom of their descent or the expandable rope protecting sleeve reaches its maximum length, the climber is able to detach breakaway wrist strap 17 from the breakaway recovery strap 14 through the low jerk detachable engagement provided between the second snap buckle 20 and the first snap buckle 16, respectively.

In the current embodiment of the present invention, the extendable sleeve 1 is constructed using durable heavy duty fabrics. Durable heavy duty fabrics that may be utilized in the construction of the extendable sleeve 1 in the current embodiment of the present invention can include but are not limited to, nylons, polyesters or other textiles that are considered 'heavy duty' that can meet or enhance the current functionality of the present invention. While the current embodiment of the present invention utilizes a durable heavy duty fabric as the material construction of the extendable sleeve 1, the preferred embodiment of the extendable rope protecting sleeve utilizes a microfiber fabric construction for the extendable sleeve 1. The microfiber construction is selected due to its known resistance to abrasive surfaces and its durability frequent instances of compression and expansion. The durable heavy duty fabric can be cut to various lengths and widths. Length of the fabric corresponds to the length of the extendable sleeve 1 while the width will correspond to the circumference of the extendable sleeve 1 when constructed. The extendable sleeve 1 is constructed from a single large piece of fabric that is folded on top of itself in various locations and then stitched up correspondingly to form the lateral protective surface 2 and the width adjuster mechanism 7. Each of the width adjuster mechanism 7*s* are peripherally coupled to a breakaway recovery strap 14 that is sewn and set into place. At this point the drawstring 8 is traversed through drawstring channel 11. After which the partially constructed extendable sleeve 1 is folded in half widthwise and sewn together along the longitudinal edge of the fabric.

In the current embodiment of the present invention, the breakaway recovery strap 14 and the breakaway wrist strap 17 are constructed from a heavy duty flexible material. The heavy duty flexible material utilized in the construction of the breakaway recovery strap 14 and the breakaway wrist strap 17 can include but are not limited to nylon, polyethylene, flexible plastics and natural fiber, as well as any combination thereof. In the preferred embodiment of the present invention, the breakaway wrist strap 17*s* utilize a side release buckle as the strap fastener 19 to secure the breakaway wrist strap 17 to a climber's wrist. In the current embodiment of the present invention, the breakaway recovery strap 14 and the breakaway wrist strap 17 are detachably coupled by the first snap buckle 16 and the second snap buckle 20. In the preferred embodiment of the present invention the first snap buckle 16 and the second snap buckle 20 are $7/16^{th}$ snaps, which provides sufficient strength and tension with a low jerk producing breaking point. During a descent the detachable engaged snap buckles allows the climber to expand the extendable sleeve 1 without using their hands. When the climber expands the extendable sleeve 1 to its maximum length or encounters increased tension, the snap buckles release avoiding unwanted entanglement with the apparatus. In addition to the deploying the extendable sleeve 1 over the climbing rope, the breakaway recovery strap 14 functions as an attachment point for a recovery line. The recovery line is secured to the breakaway recovery strap 14 positioned distal to the climbing ropes anchor point. It should be noted that the climber would have to passively secure the proximally positioned width adjuster mechanism 7 in order to recover the extendable sleeve 1 with the recovery line. Upon securing the recovery line to the breakaway recovery strap 14, the climber would be able to use the recovery line thrown over the edge of the descending surface as a means to pull the extendable sleeve 1 off of the climbing rope and down to the descended climber. This retrieval method is used in a situation that calls for a user to rappel or mountaineer down a surface that they are unlikely to return to the top of. Furthermore, the breakaway recovery strap 14 of the distal terminal end and the breakaway recovery strap 14 of the proximal terminal end relative to the anchor point can be utilized in simultaneously to retrieve the extendable sleeve 1. In this situation the breakaway recovery strap 14 of the proximal terminal end would be coupled to a carabineer of an anchor rope. The breakaway recovery strap 14 of the distal end would be coupled to the recovery line. Upon completing a descent the climber would be able to retrieve the extendable sleeve 1 and the anchor rope by pulling the climbing rope through the anchor rope and subsequently pulling the recovery line attached to the breakaway recovery strap 14 of the distal terminal end.

Although the invention has been explained in relation to its preferred embodiment, it is to be understood that many other possible modifications and variations can be made without departing from the spirit and scope of the invention as hereinafter claimed.

What is claimed is:

1. An extendable rope protecting sleeve comprises:

an extendable sleeve;

a breakaway wrist strap;

the extendable sleeve comprises a lateral protective surface, a first sleeve opening, a second sleeve opening;

the breakaway wrist strap comprises an adjustable band, a strap fastener, and a second snap buckle;

the lateral protective surface comprises an exterior lateral surface and an interior lateral surface;

both the first sleeve opening and the second sleeve opening each comprise a width adjuster mechanism and a breakaway recovery strap;

the width adjuster mechanism comprises a drawstring, a drawstring channel, and a drawstring lock;

the breakaway recovery strap comprises a loop strap and a first snap buckle;

the drawstring comprises a first drawstring end and a second drawstring end;

the channel comprises channel opening; and the extendable sleeve being detachably engaged to the breakaway wrist strap.

2. The extendable rope protecting sleeve as claimed in claim 1, wherein the detachable engagement between the extendable sleeve and the breakaway wrist strap is provided as a low jerk detachable engagement.

3. The extendable rope protecting sleeve as claimed in claim 1 comprises:

the first sleeve opening being terminally positioned on the extendable sleeve;

the second sleeve opening being terminally positioned on the extendable sleeve opposite the first sleeve opening;

the lateral protective surface being positioned between the first sleeve opening and the second sleeve opening; and the first sleeve opening, the lateral protective surface, and the second sleeve opening being centrally aligned, wherein the central alignment between the first sleeve opening, the lateral protective surface and the second sleeve opening traverse along the length of the extendable sleeve providing an interior channel for a rope.

4. The extendable rope protecting sleeve as claimed in claim 1 comprises:

the interior lateral surface being positioned concentric to the exterior lateral surface;

the exterior lateral surface being peripherally positioned to the extendable sleeve opposite the interior lateral surface;

the width adjuster mechanism of the first sleeve opening being circumferentially positioned to the first sleeve opening;

the width adjuster mechanism of the second sleeve opening being circumferentially positioned to the second sleeve opening;

the breakaway recovery strap of the first opening being tangentially positioned to the width adjuster mechanism of the first sleeve opening; and the breakaway recovery strap of the second sleeve opening being tangentially positioned to the width adjuster mechanism of the second sleeve opening.

5. The extendable rope protecting sleeve as claimed in claim 1 comprises:

the lateral protective surface being compressible between the first sleeve opening and the second sleeve opening;

the breakaway recovery strap of the first sleeve opening being extendably coupled to the lateral protective surface by way of the width adjuster mechanism of the first sleeve opening; and the breakaway recovery strap of the second sleeve opening being extendably coupled to the lateral protective surface by way of the width adjuster mechanism of the second sleeve opening.

6. The extendable rope protecting sleeve as claimed in claim 1 comprises:

the width adjuster mechanism being coincident with the lateral protective surface;

the drawstring channel being positioned between the exterior lateral surface and the interior lateral surface;

the drawstring channel being traversed by the drawstring by way of the channel openings;

the first drawstring end and the second drawstring end being peripherally positioned to the drawstring channel;

both the first drawstring end and the second drawstring end traverse the drawstring lock; and the drawstring lock being proximally positioned to the channel openings.

7. The extendable rope protecting sleeve as claimed in claim 1 comprises:

the breakaway recovery strap being coupled peripherally to the width adjuster mechanism opposite the drawstring lock;

the loop strap being distally positioned to the width adjuster mechanism;

the first snap buckle being peripherally positioned on the breakaway recovery strap adjacent to the loop strap; and the first snap buckle being detachably engaged to the breakaway wrist strap by way of the second snap buckle.

8. The extendable rope protecting sleeve as claimed in claim 1 comprises:

the breakaway wrist strap being detachably engaged to the breakaway recovery strap;

the adjustable band being securable by the strap fastener, wherein the adjustable band is securable to a user by way of the strap fastener;

the second snap buckle being peripherally positioned on the adjustable band; and the second snap buckle being detachably engaged to breakaway recovery strap by way of the first snap buckle.

9. An extendable rope protecting sleeve comprises:

an extendable sleeve;

a breakaway wrist strap;

the extendable sleeve comprises a lateral protective surface, a first sleeve opening, a second sleeve opening;

the breakaway wrist strap comprises an adjustable band, a strap fastener, and a second snap buckle;

the lateral protective surface comprises an exterior lateral surface and an interior lateral surface;

both the first sleeve opening and the second sleeve opening each comprise a width adjuster mechanism and a breakaway recovery strap;

the width adjuster mechanism comprises a drawstring, a drawstring channel, and a drawstring lock;

the breakaway recovery strap comprises a loop strap and a first snap buckle;

the drawstring comprises a first drawstring end and a second drawstring end;

the channel comprises channel opening;

the extendable sleeve being detachably engaged to the breakaway wrist strap, wherein the detachable engagement between the extendable sleeve and the breakaway wrist strap is provided as a low jerk detachable engagement;

the first sleeve opening being terminally positioned on the extendable sleeve;

the second sleeve opening being terminally positioned on the extendable sleeve opposite the first sleeve opening;

the lateral protective surface being positioned between the first sleeve opening and the second sleeve opening; and the first sleeve opening, the lateral protective surface, and the second sleeve opening being centrally aligned, wherein the central alignment between the first sleeve opening, the lateral protective surface and the second sleeve opening traverse along the length of the extendable sleeve providing an interior channel for a rope.

10. The extendable rope protecting sleeve as claimed in claim 9 comprises:

the interior lateral surface being positioned concentric to the exterior lateral surface;

the exterior lateral surface being peripherally positioned to the extendable sleeve opposite the interior lateral surface;

the width adjuster mechanism of the first sleeve opening being circumferentially positioned to the first sleeve opening;

the width adjuster mechanism of the second sleeve opening being circumferentially positioned to the second sleeve opening;

the breakaway recovery strap of the first opening being tangentially positioned to the width adjuster mechanism of the first sleeve opening;

the breakaway recovery strap of the second sleeve opening being tangentially positioned to the width adjuster mechanism of the second sleeve opening;

the lateral protective surface being compressible between the first sleeve opening and the second sleeve opening;

the breakaway recovery strap of the first sleeve opening being extendably coupled to the lateral protective surface by way of the width adjuster mechanism of the first sleeve opening; and the breakaway recovery strap of the second sleeve opening being extendably coupled to the lateral protective surface by way of the width adjuster mechanism of the second sleeve opening.

11. The extendable rope protecting sleeve as claimed in claim 9 comprises:

the width adjuster mechanism being coincident with the lateral protective surface;

the drawstring channel being positioned between the exterior lateral surface and the interior lateral surface;

the drawstring channel being traversed by the drawstring by way of the channel openings;

the first drawstring end and the second drawstring end being peripherally positioned to the drawstring channel;

both the first drawstring end and the second drawstring end traverse the drawstring lock;

the drawstring lock being proximally positioned to the channel openings;

the breakaway recovery strap being coupled peripherally to the width adjuster mechanism opposite the drawstring lock;

the loop strap being distally positioned to the width adjuster mechanism;

the first snap buckle being peripherally positioned on the breakaway recovery strap adjacent to the loop strap; and the first snap buckle being detachably engaged to the breakaway wrist strap by way of the second snap buckle.

12. The extendable rope protecting sleeve as claimed in claim 9 comprises:

the breakaway wrist strap being detachably engaged to the breakaway recovery strap;

the adjustable band being securable by the strap fastener, wherein the adjustable band is securable to a user by way of the strap fastener;

the second snap buckle being peripherally positioned on the adjustable band; and the second snap buckle being detachably engaged to breakaway recovery strap by way of the first snap buckle.

13. An extendable rope protecting sleeve comprises:

an extendable sleeve;

a breakaway wrist strap;

the extendable sleeve comprises a lateral protective surface, a first sleeve opening, a second sleeve opening;

the breakaway wrist strap comprises an adjustable band, a strap fastener, and a second snap buckle;

the lateral protective surface comprises an exterior lateral surface and an interior lateral surface;

both the first sleeve opening and the second sleeve opening each comprise a width adjuster mechanism and a breakaway recovery strap;

the width adjuster mechanism comprises a drawstring, a drawstring channel, and a drawstring lock;

the breakaway recovery strap comprises a loop strap and a first snap buckle;

the drawstring comprises a first drawstring end and a second drawstring end;

the channel comprises channel opening;

the extendable sleeve being detachably engaged to the breakaway wrist strap, wherein the detachable engagement between the extendable sleeve and the breakaway wrist strap is provided as a low jerk detachable engagement;

the first sleeve opening being terminally positioned on the extendable sleeve;

the second sleeve opening being terminally positioned on the extendable sleeve opposite the first sleeve opening;

the lateral protective surface being positioned between the first sleeve opening and the second sleeve opening;

the first sleeve opening, the lateral protective surface, and the second sleeve opening being centrally aligned, wherein the central alignment between the first sleeve opening, the lateral protective surface and the second sleeve opening traverse along the length of the extendable sleeve providing an interior channel for a rope;

the interior lateral surface being positioned concentric to the exterior lateral surface;

the exterior lateral surface being peripherally positioned to the extendable sleeve opposite the interior lateral surface;

the width adjuster mechanism of the first sleeve opening being circumferentially positioned to the first sleeve opening;

the width adjuster mechanism of the second sleeve opening being circumferentially positioned to the second sleeve opening;

the breakaway recovery strap of the first opening being tangentially positioned to the width adjuster mechanism of the first sleeve opening;

the breakaway recovery strap of the second sleeve opening being tangentially positioned to the width adjuster mechanism of the second sleeve opening;

the lateral protective surface being compressible between the first sleeve opening and the second sleeve opening;

the breakaway recovery strap of the first sleeve opening being extendably coupled to the lateral protective surface by way of the width adjuster mechanism of the first sleeve opening; and the breakaway recovery strap of the second sleeve opening being extendably coupled to the lateral protective surface by way of the width adjuster mechanism of the second sleeve opening.

14. The extendable rope protecting sleeve as claimed in claim 13 comprises:

the width adjuster mechanism being coincident with the lateral protective surface;

the drawstring channel being positioned between the exterior lateral surface and the interior lateral surface;

the drawstring channel being traversed by the drawstring by way of the channel openings;

the first drawstring end and the second drawstring end being peripherally positioned to the drawstring channel;

both the first drawstring end and the second drawstring end traverse the drawstring lock;

the drawstring lock being proximally positioned to the channel openings;

the breakaway recovery strap being coupled peripherally to the width adjuster mechanism opposite the drawstring lock;

the loop strap being distally positioned to the width adjuster mechanism;

the first snap buckle being peripherally positioned on the breakaway recovery strap adjacent to the loop strap;

the first snap buckle being detachably engaged to the breakaway wrist strap by way of the second snap buckle;

the breakaway wrist strap being detachably engaged to the breakaway recovery strap;

the adjustable band being securable by the strap fastener, wherein the adjustable band is securable to a user by way of the strap fastener;

the second snap buckle being peripherally positioned on the adjustable band; and the second snap buckle being detachably engaged to breakaway recovery strap by way of the first snap buckle.

* * * * *